US009114284B2

(12) United States Patent
Orr

(10) Patent No.: US 9,114,284 B2
(45) Date of Patent: Aug. 25, 2015

(54) STREAMER BALL

(75) Inventor: Moshe Orr, London (GB)

(73) Assignee: Limpet Sports Management B.V., Bussum (NL)

( * ) Notice: Subject to any disclaimer, the term of this patent is extended or adjusted under 35 U.S.C. 154(b) by 0 days.

(21) Appl. No.: 14/349,301

(22) PCT Filed: Oct. 5, 2011

(86) PCT No.: PCT/IB2011/054374

§ 371 (c)(1),
(2), (4) Date: Jul. 25, 2014

(87) PCT Pub. No.: WO2013/050802

PCT Pub. Date: Apr. 11, 2013

(65) Prior Publication Data

US 2014/0329626 A1 Nov. 6, 2014

(51) Int. Cl.
*A63B 43/00* (2006.01)

(52) U.S. Cl.
CPC ..... *A63B 43/00* (2013.01); *A63B 43/007* (2013.01); *A63B 2043/001* (2013.01)

(58) Field of Classification Search
CPC . A63B 43/00; A63B 43/007; A63B 2043/001
See application file for complete search history.

(56) References Cited

U.S. PATENT DOCUMENTS 2,009,759 A * 7/1935 Brown ..... 473/579
2,377,498 A * 6/1945 Jacke ..... 473/569
3,393,911 A * 7/1968 Lawson ..... 473/576
4,266,781 A * 5/1981 Blue ..... 473/585
4,294,447 A * 10/1981 Clark ..... 473/575
4,538,818 A 9/1985 Sinclair
4,826,179 A * 5/1989 Callaghan ..... 473/575

(Continued)

FOREIGN PATENT DOCUMENTS

EP 0157547 A2 10/1985
WO WO-03/041813 A1 5/2003
WO WO-2011/001298 A1 1/2011

OTHER PUBLICATIONS

International Preliminary Report on Patentability, corresponding International Application No. PCT/IB2011/054374, dated Apr. 8, 2014.
International Search Report and Written Opinion, corresponding International Application No. PCT/IB2011/054374, mailing date Jul. 2, 2012.

*Primary Examiner* — Steven Wong
(74) *Attorney, Agent, or Firm* — Marshall, Gerstein & Borun LLP

(57) ABSTRACT

The invention relates to a streamer ball 10 for use in tennis-type bat and bouncing ball games played with bats having rigid, untensioned ball-striking surfaces and comprises an impact body 12, a tail 14 and a spacer stem 16. The impact body comprises a hemispherical front compression body part 24 including a resiliently compressible frontal impact zone; and a hemispherical rear ballast body part 26. The spacer stem includes a stem formation 17, an anchor formation 28 embedded in the rear ballast body part 26 and an attachment formation 32 for the tail comprising elongate streamers which extend rearwardly from the spacer stem in flight. The rear ballast body part has a greater density than that of the front compression body part and the combined mass of the rear ballast body part and the spacer stem provides ballast rearwardly of the front compression body part providing for adequate compression of the frontal impact zone upon impact.

16 Claims, 7 Drawing Sheets

(56) References Cited

U.S. PATENT DOCUMENTS

| | | | | | |
|---|---|---|---|---|---|
| 5,112,061 | A * | 5/1992 | Lamle | 473/473 |
| 5,310,194 | A * | 5/1994 | Scheel | 473/569 |
| 5,577,732 | A * | 11/1996 | Spector | 473/576 |
| 5,615,879 | A * | 4/1997 | Bailey | 473/424 |
| 5,813,931 | A * | 9/1998 | Gormley | 473/575 |
| 6,733,405 | B2 * | 5/2004 | Gormley | 473/575 |
| 8,771,106 | B1 * | 7/2014 | Boulanger et al. | 473/423 |

* cited by examiner

STREAMER BALL

FIELD OF INVENTION

This invention relates to a streamer ball for use in tennis-type bat and ball games wherein the ball is required to bounce on a playing surface.

The streamer ball is configured for use with bats having an untensioned, rigid ball-striking surface. As such, unless otherwise specified, any reference herein to a "bat" must be interpreted to mean a reference to a bat having an untensioned, rigid ball-striking surface.

BACKGROUND TO INVENTION

In the context of this specification, a streamer ball is a ball for use in tennis-type ball games of a type having an impact body and a tail comprising a number of elongate flexible streamers which are attached to the impact body for stabilizing the flight orientation of the ball. Streamer balls of this type are known.

A streamer ball of this type is disclosed in U.S. Pat. No. 5,813,931 (assigned to European Sports Merchandising BV). The streamer ball comprises a ball and a tail comprising a number of elongate streamers directly attached to the ball and extending therefrom, for use in tennis-type bouncing ball games. U.S. Pat. No. 5,813,931 discloses a number of performance parameters for such a streamer ball and specifically for the tail of the ball, that provide for desired bounce and flight qualities that enable a tennis-type game to be played with such a streamer ball. The use of a tail connected to a ball has a number of benefits when playing a tennis-type ball game. Firstly, the use of a tail which trails behind the ball in flight creates drag which slows the ball down so that when the ball is struck with a bat, the distance that the ball can travel is effectively reduced, thereby permitting a tennis-type ball game to be played in a relatively small area while the ball can still be struck at "full strength".

A further benefit of such a tail is to reduce any tendency of the ball to spin or swerve during flight. The tail streams out behind the ball in flight so as to define a dynamically changing and fluttering asymmetrical profile which rapidly reduces any side spin or top spin or swerve which is imparted to the ball upon impact by a bat, thereby causing the ball to follow a regular flight path.

A disadvantage associated with the use of a ball having a tail formed of a plurality of streamers which are directly attached to the ball as is disclosed in U.S. Pat. No. 5,813,931, is that the tail, during play, becomes tangled with the bat or the ball, resulting in interference with the flight of the streamer ball and the streamers being destroyed relatively quickly. This disadvantage is overcome by the streamer ball disclosed in PCT/IB02/04673 (Gormley). The streamer ball includes a tail having an elongate flexible spacer stem and a number of streamers that are spaced from the impact body by means of an elongate spacer stem. The spacer stem defines an anchor formation at one of its ends, whereby the stem is anchored to the impact body and an attachment formation at its other end, whereby the streamers are attached to the stem. With the tail separated from the ball by the spacer stem, the streamers cannot easily become tangled with the bat or the ball.

A further benefit of a spacer stem is that in spacing the streamers from the streamer ball, the effect of the streamers on the regulation of the flight path of the ball, is enhanced. The extra leverage afforded by the streamers pulling on the distal end of the spacer stem rather than directly on the impact body dramatically improves the flight stability of the streamer ball.

As such, after impact with a bat or playing surface the provision of a spacer stem enhances the ability of the streamer ball to rapidly regain an aerodynamically stable attitude in flight.

An important performance characteristic for a ball which is intended for use in tennis-type bat and ball games, is that the ball should have sufficient bounce after striking a playing surface to enable the ball to be struck by a player after bouncing. An effect of the attachment of a flexible tail to a ball is that the mass of the tail causes a reduction in amount of bounce of the ball. A flexible tail deforms when the ball to which the tail is attached, impacts a bat or playing surface and consequently acts as a shock absorber dissipating some of the energy which is transferred to the ball upon impact, thereby reducing the spring of the ball off the bat or playing surface. It is thus particularly important in the case of a streamer ball which is intended for use in tennis-type bat and ball games, to provide a flexible tail assembly wherein the free part of the tail assembly disposed externally of the ball, is of negligible mass compared to the mass of the ball to which the tail assembly is attached, so as to have a minimal effect on the bounce height of the ball.

Strung racquets are usually provided with a network of strings under tension strung across a frame at the head of the racquet. When using a strung racquet, the resilient compressibility of the ball-striking surface of such a racquet, provides a "trampoline effect" which allows the ball to dwell on the ball-striking surface at impact for a significantly longer period of time than is the case with a bat which has an untensioned ball-striking surface. Due to the inherent resilient compressibility of the ball-striking surface of a strung racquet, the balls selected for use therewith can allow for less compression upon impact compared to a ball which is designed to be struck by a bat. An important consideration in the design of a ball for use in bat and ball-type games played with a bat having an untensioned, rigid ball-striking surface, is that the ball should have sufficient resilient compressibility so that when it is struck by the bat or the ball bounces on a rigid playing surface, the dwell time of the ball upon the bat or playing surface at impact is sufficiently long as indicated by the relative depth of compression of the ball, so as to transfer adequate kinetic energy to the ball so as to provide the necessary spring off the bat or playing surface and consequently a satisfactory impact feel, sound and impact speed when leaving the bat or playing surface after impact. The greater the compression of the ball upon impact, the greater the amount of energy which is stored in the ball which in turn causes greater spring off the bat or playing surface when the energy is released as the ball regains its shape after the initial impact. There is thus a direct relationship between the depth of compression and the amount of energy which is stored by the ball upon impact and released immediately after full compression is achieved. It is for this reason that the current Applicant has sought to design streamer balls wherein the balls have a high degree of resilient compressibility in order to achieve a high degree of spring off a bat or playing surface.

A further important consideration in the design of balls for use in tennis-type bat and ball games played with bats having untensioned, rigid ball-striking surfaces, is that the balls should have sufficient mass in order for the ball to compress sufficiently upon impact in order to provide the trampoline effect referred to above, off a bat or playing surface and also to achieve solid contact between the ball and the ball-striking surface of a bat.

The current Applicant has identified a need to supply bats having rigid, untensioned ball-striking surfaces having a relatively low weight. The cost of the bats in sets of bats and balls is the major component of such sets. It is an object of the present invention, to provide for the production of relatively lightweight bats which use less material and are thus relatively inexpensive to produce. It is also a requirement for bats which are to be used by children, that the bats must be relatively lightweight. In order to do so, it is necessary to provide balls for such bats which are correspondingly light in weight and which are matched in terms of their weight to the weight of the particular bat with which the balls are to be used. In this regard, the Applicant believes that a bat should be at least five times heavier than a ball to be used therewith and preferably, at least ten times heavier than the ball so as to provide a solid impact feel and avoid unpleasant jarring and vibration upon impact. As a result of the provision of relatively lightweight bats is that the balls used with such bats must also be correspondingly light in weight. The current Applicant has encountered a problem with streamer balls having relatively lightweight impact bodies having a mass of less than 30 g (excluding the mass of the streamers) which allow for the use of relatively lightweight bats. Such streamer balls having relatively lightweight impact bodies are unable to achieve the compressibility required for adequate impact performance, due to their lack of mass in relation to the compressibility of the frontal impact zone of such impact bodies. It will be appreciated that the streamers, due to their high degree of flexibility and low mass, are unable to exert a material force on the frontal impact zone of the impact body upon impact.

The abovementioned characteristics of streamer balls can be contrasted with a shuttlecock, for example, for use in badminton games wherein the shuttlecock is not allowed to bounce in terms of the rules of badminton. The base of a shuttlecock is typically of cork or plastic having an outer fabric or leather cover, which has negligible resilient compressibility and a skirt which is attached to a rear end of the base. The skirt typically comprises a cone-shaped circle of feathers or a similarly shaped integral injection moulded plastic structure. There are a number of differences between shuttlecocks and streamer balls as described hereinabove. Firstly, the configuration of the skirt of a shuttlecock is that of a semi-rigid, symmetrical conical structure permitting a degree of spin in flight by slicing or striking the base at an angle, at low speeds, to the face of the racquet. A large degree of the flight stability of a badminton shuttlecock is derived from the gyroscopically acting centrifugal forces imparted by the axial spin of the shuttlecock in flight, derived from the angled fluted surface of the skirt. At low speeds this stabilizing effect is greatly reduced and the shuttlecock is much less stable in flight. For this reason, overhead service similar to that in tennis, is impractical as the shuttlecock is unstable at the low speeds of the shuttlecock when it is tossed up by hand prior to the service stroke. As stated above, the streamers of a streamer ball have a dynamic fluttering asymmetrical profile in flight as exhibited by the independent movement of the individual streamers making up the tail assembly and are thus designed to reduce spin. Under normal flight conditions, a streamer ball has no axial spin. Secondly, as badminton games are played with tensioned racquets, the base of the shuttlecock has negligible resilient compressibility as the inherent resilience and compressibility of the racquet face provides the required trampoline effect upon impact with the base of the shuttlecock. As such, a shuttlecock is entirely unsuitable for playing a game wherein the shuttlecock is struck by a bat having an untensioned, rigid ball-striking surface. Thirdly, the portion of the skirt of a shuttlecock which projects from the base, typically has a high mass relative to the total mass of the shuttlecock (typically approximately 30% of the total mass of the shuttlecock) which permits a tumbling net shot to be played wherein the shuttlecock is sliced at low speeds causing it to tumble over a few times. As bounce is not allowed in badminton games, the relatively high mass of the skirt is not disadvantageous but desirable so as to produce the required flight characteristics for badminton games. Streamer balls are far more stable at low speeds. Fourthly, as the skirt of the shuttlecock is directly attached to and extends directly outwardly from the base, this presents similar problems to those encountered with streamer balls wherein the streamers are directly attached to the ball, namely, that if the shuttlecock is struck at an angle to its flight path by a bat, the skirt is often struck causing damage to the skirt. In addition, the skirt protrudes outwardly from the base at a far greater angle than the spacer stem and tails of a streamer ball which exacerbates the problem. Fifthly, because the mass of the skirt is relatively high compared to the mass of the base and consequently as the centre of the mass of the shuttlecock is spaced a significant distance rearwardly of the centre of mass of the base (without the skirt), the shuttlecock takes a relatively long time to turn over after impact by a bat and regain an aerodynamically stable attitude in flight, thereby rendering the shuttlecock unsuitable for playing games at low speeds in relatively small playing areas.

U.S. Pat. No. 4,538,818 discloses a "shuttlecock" which can be used with a variety of bats or racquets for both badminton and tennis-type games. The base (referred to as a "head") has a spherical shape of tennis ball size and is designed to bounce. Although the shuttlecock disclosed in U.S. Pat. No. 4,538,818 is designed to bounce it still suffers from the same deficiencies as described hereinabove in relation to a conventional shuttlecock. In addition, as the mass of the skirt is relatively high compared to the mass of the base, causing the centre of mass of the shuttlecock to be spaced a significant distance rearwardly of the centre of mass of the base (without the skirt), the shuttlecock takes a relatively long time to turn over in flight and also to regain an aerodynamically stable attitude in flight, thereby rendering the shuttlecock unsuitable for playing games in relatively small playing areas. Furthermore, the offset between the centre of mass of the shuttlecock and the centre of mass of the base (without the skirt) causes erratic bounce off a playing surface due to the centre of mass of the shuttlecock being spaced a significant distance rearwardly of the impact zone of the base. The shuttlecock design disclosed in U.S. Pat. No. 4,538,818 cannot be applied to shuttlecocks having relatively small bases (of a size smaller than that of a tennis ball) as either the lack of mass in the smaller base will render it unstable in flight and unable to compress sufficiently at impact or if the density of the base is increased it renders the base less resilient and unable to achieve the compressibility required for adequate impact performance. It is for this reason that the shuttlecock disclosed in U.S. Pat. No. 4,538,818 is described as a "large" shuttlecock having a head of a size comparable to that of a tennis ball.

Reference is made herein to a "drop test". In this test which is commonly used for balls of various types, the streamer ball is dropped (with a spacer stem attached to the impact body but without any streamers attached to the spacer stem) with its impact body facing downwards with the spacer stem in a vertical orientation, from a height of 254 cm (100 inches) onto an untensioned, rigid, flat, horizontal, solid impact surface such as concrete or a thick steel plate, and the resulting compression of the impact body of the streamer ball upon impact with the impact surface and/or the height to which the ball bounces after impacting the surface, is measured. In order to determine the bounce height of a ball, the maximum height to which the ball bounces after impacting the impact surface is measured. For example, the International Tennis Federation specification for the bounce height of a tennis ball is between 135 cm and 147 cm when subjected to a drop test from the same height. A number of techniques are used to measure the compression depth of a ball upon impact with the impact surface. One such technique involves marking the impact zone of the ball with a transferrable marking substance, such as talcum powder, measuring the dimensions of the mark left behind on the impact surface after impact by the ball and applying the dimensions of the mark to the geometry of the ball, calculating the depth of compression of the ball upon impact. Any reference hereinafter to a "drop test" must be interpreted to mean the test described hereinabove wherein a streamer ball is dropped (with a spacer stem attached to the impact body but without any streamers attached to the spacer stem) from a height of 254 cm onto a rigid, flat, horizontal, solid impact surface.

It is an object of the present invention to provide streamer balls having relatively low mass impact bodies having relatively soft, low density frontal impact zones so as to achieve a high degree of compression upon impact by a bat or playing surface, but which have particular design features which take into account the abovementioned design criteria and deficiencies and which render the streamer balls particularly suitable for use in tennis-type bat and ball games played with a bat having an untensioned, rigid ball-striking surface.

SUMMARY OF INVENTION

According to the invention there is provided a streamer ball for use in bat and ball tennis-type games wherein the ball is required to bounce on a playing surface and wherein the games are played with a bat having an untensioned, rigid ball-striking surface, the streamer ball comprising:

an impact body having a leading end and a trailing end and a central longitudinal axis extending between the leading and trailing ends and passing through the centre of mass of the impact body, the impact body including a generally convexly curved frontal impact zone defining the leading end, which includes a resiliently compressible impact member of a homogeneous polymeric foam material having a density of between 25 kg/m$^3$ and 70 kg/m$^3$, which is operable to resiliently compress when an impact force is applied to the frontal impact zone;

a tail comprising at least one elongate thin, flexible streamer configured to trail behind the impact body in flight; and a spacer stem comprising a resiliently flexible, elongate stem formation having two ends; an anchor formation at one end of the stem formation which is formed to provide for connection of the stem formation to the impact body; and an attachment formation at the other end of the stem formation providing for attachment of the tail to the stem formation, the spacer stem separating an attachment location of the tail from the trailing end of the impact body by at least 15 mm, the configuration of the impact body and the spacer stem attached thereto, being such that the frontal impact zone of the impact body compresses to a compression depth of between 3 mm and 10 mm when subjected to a drop test and the impact body bounces to a height of at least 50 cm when subjected to said drop test, the streamer ball including ballast comprising any components of the streamer ball which have a relatively higher density than the density of the impact member and which are disposed rearwardly of the impact member, but excluding the tail, the mass of the ballast being at least three times the mass of the impact member of the impact body, with the combined mass of the ballast and the impact member being less than 30 g, the streamer ball defining a separation plane which separates the impact member from the ballast, the separation plane extending substantially perpendicularly with respect to the longitudinal axis and intersecting the longitudinal axis at a point spaced at least 5 mm rearwardly of the leading end.

In use, the spacer stem serves to space the tail from the impact body thereby to prevent the streamer from becoming entangled in the impact body upon impact by a bat or with the bat itself and also to tether the tail to the impact body. The design of the spacer stem and the streamer is such that the combined mass of the spacer stem and the streamer is the minimum required for the function which the spacer stem and the streamer are required to perform.

Preferably, the configuration of the impact body and the spacer stem may be such that the frontal impact zone of the impact body compresses to a compression depth of 4 mm to 8 mm when subjected to said drop test.

The combined mass of the ballast and the frontal impact zone may be between 3 g and 25 g.

The mass of the ballast may be at least five times the mass of the impact member of the impact body.

The polymeric foam material of the impact member may be of the closed cell type. The impact member of the impact body may have a Shore Hardness of not more than 25 on the type A durameter scale.

In a particular embodiment, the impact body may comprise a front compression body part which comprises said frontal impact zone and a rear ballast body part of a material which is relatively more dense than the material constituting the front compression body part thereby rendering the rear ballast body part relatively heavier than the front compression body part. The rear ballast body part may include a ballast insert. The ballast insert may be configured such that it has a width dimension which is at least half of a maximum width dimension of the impact body wherein the width dimensions of the ballast insert and of the impact body are calculated along axes perpendicular to the longitudinal axis of the impact body.

In a particular embodiment, the streamer ball may include a cover element of a durable wear-resistant material covering the frontal impact zone of the impact body. In use, the cover element protects the outer surface of at least the frontal impact zone of the impact body from damage due to continual impacts by a bat or with a playing surface. It will be appreciated that the cover element is not taken into consideration when determining the relationship between the mass of the impact member and any other components of the streamer ball disposed rearwardly of the separation plane.

Preferably, the configuration of the impact body and the spacer stem may be such that the impact body bounces to a height of at least 80 cm when subjected to a drop test as defined hereinabove.

The streamer constituting the tail may comprise an elongate flexible element of synthetic plastics material having a thickness of less than 0.2 mm. The streamer may have a thickness less than 0.06 mm. The streamer may have a length of not less than two times the length dimension of the impact body. More specifically, the tail may comprise two or more streamers. The streamers constituting the tail of the streamer ball are configured and formed of a material that provides for the streamers to oscillate rapidly and generate a fluttering noise during flight which, it is considered, will constitute a pleasing effect when playing a game with the streamer ball.

The rear ballast body part may be disposed between the front compression body part of the impact body and the spacer stem and may be of a resiliently compressible material so as to serve as a shock absorber for absorbing impact forces which act upon the front compression body part and which are transmitted rearwardly when the front compression body part impacts a relatively hard surface, in use.

BRIEF DESCRIPTION OF DRAWINGS

Further features of the invention are described hereinafter by way of a non-limiting example of the invention, with reference to and as illustrated in the accompanying diagrammatic drawings. In the drawings.

DESCRIPTION OF PREFERRED EMBODIMENTS

Figure 1:
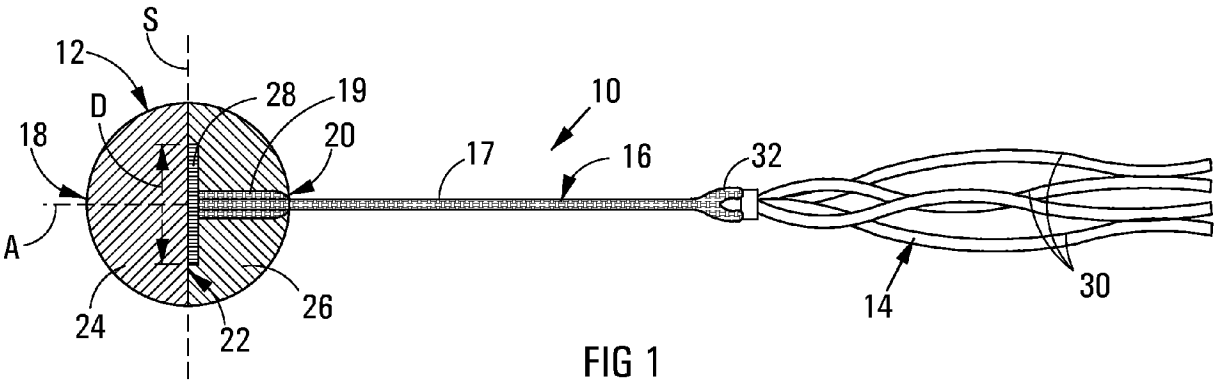
FIG. 1 shows a cross-sectional side view of a streamer ball for use in a bat and ball-type game, in accordance with the invention.

With reference to FIG. 1 of the drawings, a streamer ball for use in tennis-type bat and bouncing ball games, in accordance with the invention, is designated generally by the reference numeral 10. The streamer ball 10 is specifically configured for use with bats having untensioned, rigid ball-striking surfaces. The streamer ball 10 comprises, broadly, an impact body 12 in the form of a spherical ball, a tail 14 and a spacer stem 16, the spacer stem being connected at one end thereof to the impact body 12 and having the tail 14 attached to the other end thereof. The impact body 12 is of solid closed cell polymeric foam and has a leading end 18 and a trailing end 20 and defines a longitudinal axis "A" extending between the leading and trailing ends and passing through the centre of mass of the impact body. The distance between the leading and trailing ends of the impact body is hereinafter referred to as the length of the impact body. The impact body 12 comprises two hemispherical body parts which are joined to one another along a join line 22. More particularly, the impact body has a frontal impact zone which comprises an impact member in the form of a hemispherical front compression body part which defines the leading end 18 and a hemispherical rear ballast body part 26 which defines the trailing end 20.

The frontal impact zone is configured for impact by a bat when playing a ball game and for impact with a playing surface. The impact body defines a separation plane "S" which is coincident with the join line 22 and which divides the impact body into the front compression body part and the rear ballast body part. More specifically, the separation plane S extends perpendicularly to and intersects the longitudinal axis A. The separation plane S intersects the longitudinal axis A at a point 15 mm rearwardly from the leading end of the impact body.

The front compression body part 24 of the impact body 12 is of a resiliently compressible homogeneous solid ethylene vinyl acetate (EVA) closed cell foam material having a density of between 25 kg/m$^3$ and 35 kg/m$^3$. The front compression body part 24 has a Shore Hardness of not more than 25 on the type A durameter scale. The rear ballast body part 26 is of a solid EVA foam material which is relatively more dense than the foam material of the front compression body part.

The spacer stem 16 includes a stem formation 17 having a distal end and a proximal end. The spacer stem further includes a disc-shaped anchor formation 28 at the proximal end of the stem formation which is embedded in the EVA foam material of the impact body and an attachment formation 32 at the distal end of the stem formation. The stem formation 17, the anchor formation 28 and the attachment formation 32 are integrally moulded of plastics material. The anchor formation 28 provides an anchor for anchoring the stem formation of the spacer stem to the impact body. In this example, the denser EVA foam material of the rear ballast body part 26 together with the mass of the spacer stem 16 provide ballast rearwardly of the frontal impact zone which provides the streamer ball with desirable performance characteristics as is explained in further detail hereinbelow. The diameter D of the anchor formation 28 is slightly greater than half of the diameter of the impact body 12.

The tail 14 which does not form part of the ballast, comprises a number of thin, flexible streamers 30 that are formed of a synthetic plastic material. More particularly, the streamers are in the form of elongate, thin, flat flexible elements having a thickness of less than 0.06 mm. The streamers have a length of not less than two times the length of the impact body 12. The configuration and the material of the streamers forming the tail 14 is such that the streamers define a dynamically changing and fluttering asymmetrical profile in flight and oscillate rapidly during flight thereby generating a fluttering noise.

The stem formation 17 is formed of a resiliently flexible synthetic plastic material. The streamers are attached to the attachment formation 32 of the stem formation 17. The stem formation 17 is connected at a proximal end thereof to the ballast insert 28 which is embedded within the rear ballast body part of the impact body. The stem formation 17 includes rigid stiffening fins 19 at the proximal end thereof for limiting flexion of the stem formation 17 within the impact body and for reinforcing the joint between the stem formation and the anchor formation. The spacing provided by the spacer stem 16 between the trailing end of the impact body 12 and the attachment formation 32 is at least 15 mm so as to ensure that the streamers do not become entangled with the impact body when struck by a bat, in use, or with the bat itself. The combined mass of the front compression body part and of the ballast, is less than 30 g and more specifically between 3 g and 25 g.

In a typical example of the streamer ball 10, the front compression body part 24 of the impact body may be of EVA foam having a density of approximately 30 kg/m$^3$, while the rear ballast body part 26 thereof may have a density of approximately 200 kg/m$^3$. The impact body has a diameter of 50 mm. When subjected to a drop test, the frontal impact zone compresses approximately 6 mm and bounces to a height of approximately 100 cm. The front compression body part of the impact body has a mass of 1 g, while the rear ballast body part 26 has a mass of 6 g. The spacer stem 16 has a total mass of 2.1 g. The mass of the ballast provided by the combined mass of the rear ballast body part (6 g) and of the spacer stem (2.1 g) amounts to a total mass of 8.1 g which is 8.1 times the mass of the frontal impact zone (1 g), thereby meeting the requirements for the ballast to have a mass of at least three times the mass of the frontal impact zone in order for the streamer ball to exhibit the desirable performance characteristics as described hereinbelow.

Figure 2:
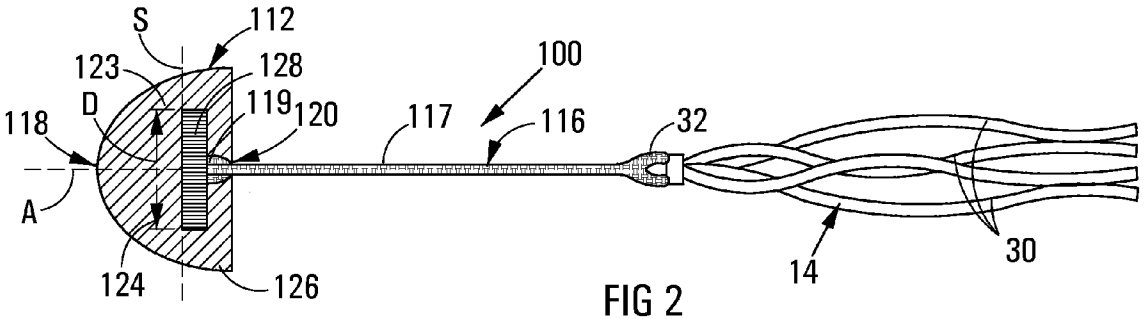
FIG. 2 shows a cross-sectional side view of a second embodiment of a streamer ball for use in a bat and ball-type game, in accordance with the invention.

With reference to FIG. 2 of the drawings, a second embodiment of a streamer ball in accordance with the invention is designated generally by the reference numeral 100. The streamer ball 100 is similar to the streamer ball 10, with a difference being the configuration of the impact body. As such, in FIG. 2, those features of the streamer ball 100 which are the same as and/or similar to those of the streamer ball 10 are designated by the same and/or similar reference numerals.

The streamer ball 100 includes a solid closed cell, homogeneous EVA foam impact body 112 having a hemispherical shape and a spacer stem 116 having a tail 14 attached thereto. The impact body 112 has a leading end 118 and a trailing end 120. The entire impact body 112 is of the same solid foam material which has a density of between 25 kg/m$^3$ and 35 kg/m$^3$ and which is resiliently compressible. The impact body 112 defines a front compression body part 124 which constitutes the frontal impact zone, and a rear ballast body part 126 which is separated from the front compression body part by a separation plane S as shown in FIG. 2. The separation plane thus demarcates the division between the front compression body part and the rear ballast body part of the impact body. The front compression body part 124 has a Shore Hardness of not more than 25 on the type A durameter scale.

The spacer stem 116 includes a disc-shaped anchor formation 128 which is relatively thicker than the anchor formation 28 of the streamer ball 10, with the additional material providing ballast rearwardly of the frontal impact zone. The EVA material of the rear ballast body part 126 and the spacer stem formation 116, provide ballast. As is the case with the anchor formation 28, the anchor formation 128 is embedded in the rear ballast body part 126, with the separation plane "S" being spaced at least 15 mm rearwardly from the leading end and extending along a front face of the anchor formation 128. The diameter D of the anchor formation 128 is slightly greater than half of the diameter of the base of the hemispherical impact body.

The spacer stem 316 provides ballast having a mass which is at least three times the mass of the front compression body part.

Figure 3:
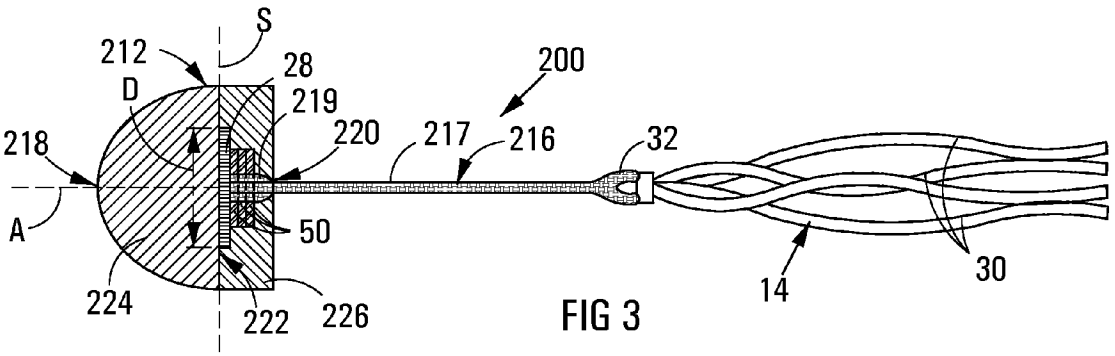
FIG. 3 shows a cross-sectional side view of a third embodiment of a streamer ball for use in a bat and ball-type game, in accordance with the invention.

With reference to FIG. 3 of the drawings, a third embodiment of a streamer ball in accordance with the invention, is designated generally by the reference numeral 200. The streamer ball 200 is similar to the streamer ball 10, with the only difference being the configuration of the impact body. In FIG. 3, the same as and/or similar reference numerals are used to designate those features of the streamer ball 200 which are the same as and/or similar to those of the streamer ball 10.

The streamer ball 200 includes an impact body 212 having a leading end 218 and a trailing end 220. The impact body comprises a hemispherical front compression body part 224 which constitutes the frontal impact zone of the impact body and a disc-shaped rear ballast body part 226. The front compression body part is of a solid, closed cell homogeneous EVA foam material having a density of between 25 kg/m$^3$ and 35 kg/m$^3$ and a shore Hardness of not more than 25 on the type A durameter scale. The front compression body part defines the leading end 218. The rear ballast body part is of EVA foam material of the same closed cell type having a density which is relatively greater than that of the foam material of the front compression body part. The rear ballast body part 226 defines a trailing end 220 and is fixed to a rear side of the front compression body part 224 along a join line 222 which is coincident with a separation plane S which demarcates the division between the front compression body part and the rear ballast body part.

The streamer ball 200 includes a spacer stem 216 having a tail 14 attached thereto. The spacer stem 216 includes an anchor formation 28 which is embedded in the EVA foam of the rear ballast body part. The stem formation 217 includes rigid stiffening fins 219 at the proximal end thereof. The streamer ball 200 further includes three metal ballast washers 50 which are secured to the stiffening fins 219 and embedded in the EVA material of the rear ballast body part of the impact body. The mass of the foam material of the rear ballast body part 226 which is relatively more dense than the foam material of the front compression body part 224, together with the mass of the spacer stem 216 and the mass of the three ballast washers 50 provides ballast rearwardly of the frontal impact zone. The mass of the ballast is at least three times the mass of the front compression body part. The diameter D of the anchor formation is slightly greater than half of the diameter of the rear ballast body part 226. The streamer ball 200 is in all other respects the same as the streamer ball 100.

Figure 4:
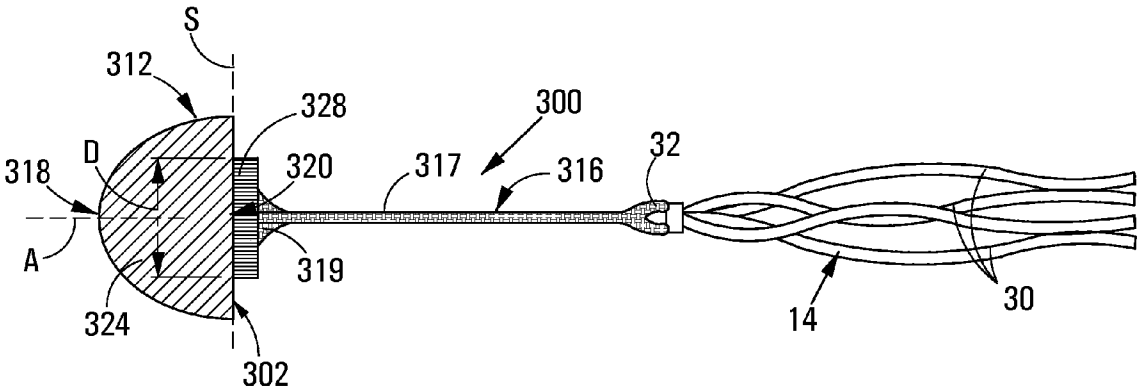
FIG. 4 shows a cross-sectional side view of a fourth embodiment of a streamer ball in accordance with the invention.

With reference to FIG. 4 of the drawings, a fourth embodiment of a streamer ball in accordance with the invention, is designated generally by the reference numeral 400. The streamer ball 400 is similar to the streamer ball 100, with a difference being that the entire spacer stem is disposed externally of the impact body, with the anchor formation of the spacer stem being secured to a rear side of the impact body. As such, in FIG. 4, those features of the streamer ball 300 which are the same as and/or similar to those of the streamer ball 100 are designated by the same and/or similar reference numerals.

The streamer ball 300 includes an impact body 312 having a leading end 318 and a trailing end 320. The impact body comprises a hemispherical impact compression body 324 which constitutes the frontal impact zone of the impact body. The compression body 324 is of a solid, closed cell homogeneous EVA foam material having a density of between 25 kg/m$^3$ and 35 kg/m$^3$ and a Shore Hardness of not more than 25 on the type A durameter scale. The streamer ball includes a spacer stem 316 having a tail 14 attached thereto. The spacer stem 316 includes an anchor formation 328 which is secured to a rear face 302 of the impact body. The anchor formation 328 of the spacer stem 316 is similar to the anchor formation 128 of the spacer stem 116 of the streamer ball 100 and as such, is relatively thicker than is required for the sole purpose of anchoring the spacer stem to the trailing end of the impact body and thus provides ballast rearwardly of the frontal impact zone. The stem formation 317 has strengthening ribs 319 at its proximal end to provide for a relatively strong connection to the anchor formation 328.

The spacer stem 316 provides ballast which is disposed rearwardly of the compression body 324. The separation of the anchor formation 328 from the compression body 324 is designated by a separation plane "S". The separation plane extends along the rear face of the compression body and intersects the longitudinal axis A at a point 15 mm rearwardly of the leading end of the compression body. The mass of the ballast disposed rearwardly of the demarcation plane, has a mass of at least three times the mass of the compression body 324.

Figure 5:
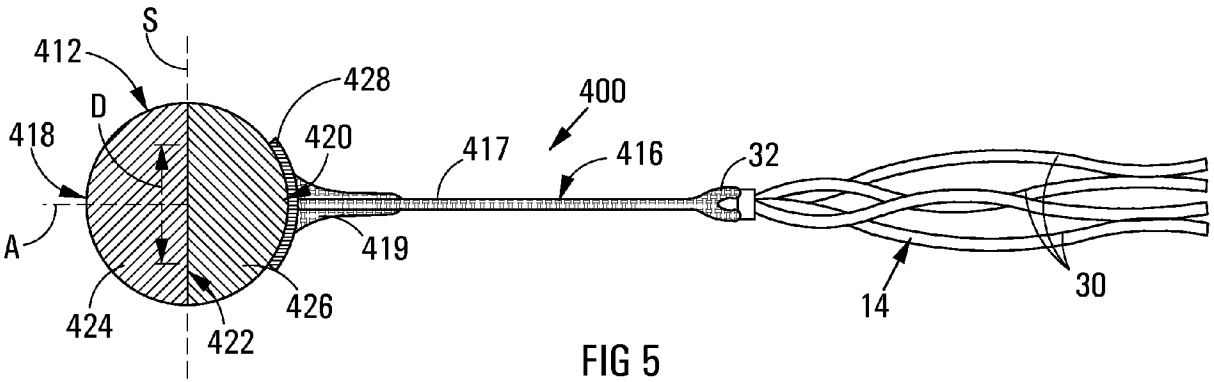
FIG. 5 shows a cross-sectional side view of yet a fifth embodiment of a streamer ball in accordance with the invention.

With reference to FIG. 5 of the drawings, a fifth embodiment of a streamer ball in accordance with the invention, is designated generally by the reference numeral 400. The streamer ball 400 is similar to the streamer ball 10, with a difference being that the spacer stem is disposed externally of the impact body, with the spacer stem being connected to the trailing end of the impact body. As such, in FIG. 5 the same as and/or similar reference numerals are used to designate those features of the streamer ball 400 which are the same as and/or similar to those of the streamer ball 10. The streamer ball 400 includes a solid, closed cell, homogeneous EVA foam impact body 412 having a spherical shape and a spacer stem 416 having a tail 14 attached thereto. The impact body 412 has a leading end 418 and a trailing end 420. The impact body 412 comprises two hemispherical body parts which are joined to one another along a join line 422. More particularly, the impact body comprises a hemispherical front compression body part 424 which constitutes the frontal impact zone and which defines the leading end 418; and a hemispherical rear ballast body part 426 which defines a trailing end 420. The impact body defines a separation plane "S" which is coincident with the joint line 422 and which divides the impact body into the front and rear parts. More specifically, the separation plane "S" extends perpendicularly to and intersects the longitudinal axis "A". It will be appreciated that the separation plane "S" intersects the longitudinal axis "A" at a point at least 15 mm rearwardly from the leading edge of the impact body.

The front compression body part 424 of the impact body 412 is of a resiliently compressible homogeneous solid EVA closed cell foam material having a density of between 25 kg/m$^3$ and 35 kg/m$^3$ and has a Shore Hardness of not more than 25 on the type A durameter scale. The rear ballast body part 426 is of a solid EVA material which is relatively more dense than the foam material of the front compression body part. The spacer stem 416 includes a cup-shaped anchor formation 428 which is secured to the impact body at its trailing end. The stem formation 417 of the spacer stem includes reinforcing ribs 419 which provide for a relatively strong connection to the anchor formation 428.

The EVA foam material of the rear ballast body part 426 and the spacer stem 416 provide ballast rearwardly of the front compression body part and have a combined mass which is at least three times the mass of the front compression body part.

Figure 6A:
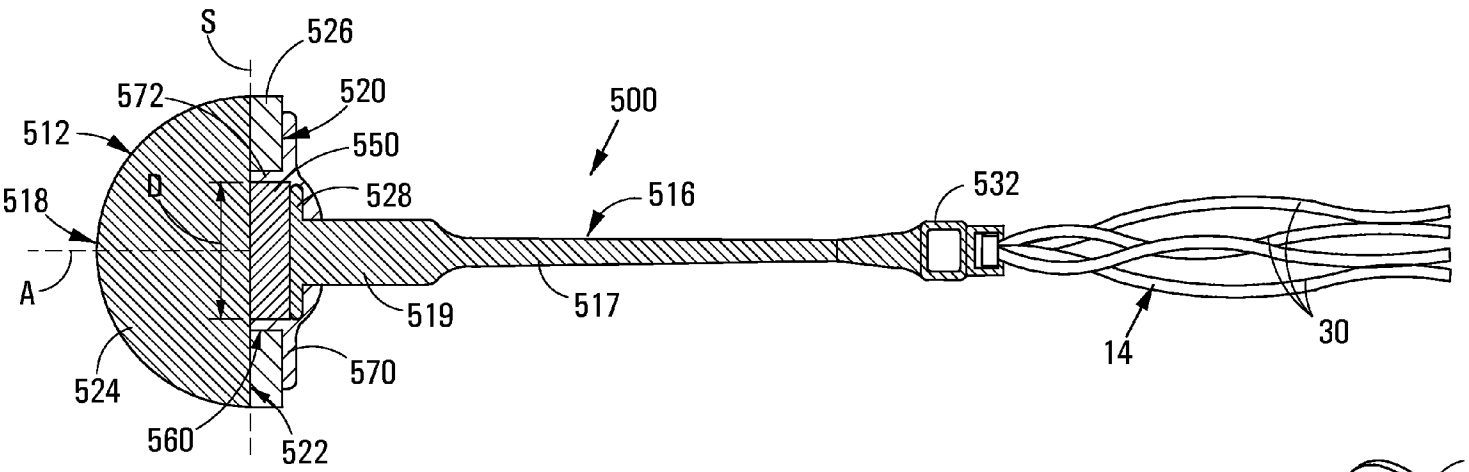
FIG. 6A shows a cross-sectional side view of a sixth embodiment of a streamer ball in accordance with the invention.
Figure 6B:
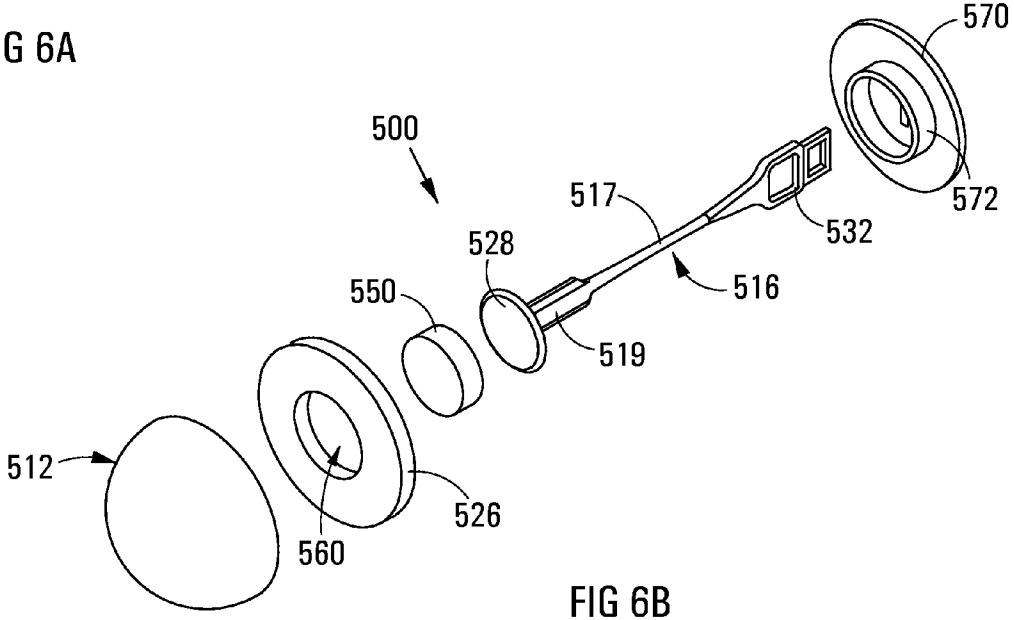
FIG. 6B shows an exploded three-dimensional view of the streamer ball of FIG. 6A, with the streamers omitted for the sake of clarity.

With reference to FIGS. 6A and 6B of the drawings, a sixth embodiment of a streamer ball in accordance with the invention, is designated generally by the reference numeral 500. The streamer ball 500 is similar to the streamer ball 200, with differences being the configuration of the impact body and of the ballast. In FIGS. 6A and 6B, the same and/or similar reference numerals are used to designate those features of the streamer ball 500 which are the same as and/or similar to those of the streamer ball 200.

The streamer ball 500 includes an impact body 512 having a leading end 518 and a trailing end 520. The impact body comprises a hemispherical front compression body part 524 which constitutes the frontal impact zone of the impact body and an annular rear ballast body part 526. The front compression body part is of a solid, closed cell homogeneous EVA foam material having a density of between 25 kg/m$^3$ and 35 kg/m$^3$ and a shore Hardness of not more than 25 on the type A durameter scale. The front compression body part defines the leading end 518. The rear ballast body part 526 is of solid closed cell homogeneous EVA foam material having a density which is relatively greater (in the region between 50 kg/m$^3$ and 60 kg/m$^3$) than that of the foam material of the front compression body part. The rear ballast body part 526 defines a trailing end 520 and is bonded by means of a suitable adhesive to a rear side of the front compression body part 524 along a join line 522 which is coincident with a separation plane S which demarcates the division between the front compression body part and the rear ballast body part. The rear ballast body part 526 defines a central aperture 560.

The streamer ball 500 includes a plastics spacer stem 516 having a stem formation 517 and an attachment formation 532 at a distal end thereof to which a tail 14 is attached. The spacer stem 516 includes stiffening fins 519 and an anchor formation 528 at a proximal end thereof. The streamer ball 500 further includes a disc-shaped ballast washer 550 which is located within the aperture 560 of the rear ballast body part 526 and bonded to the rear side of the front compression body part by means of a suitable adhesive. The anchor formation 528 of the spacer stem 516 is in turn bonded to a rear face of the ballast washer 550.

The streamer ball 500 further includes a semi-rigid plastics rear cover plate 570 having a boss 572 in which the anchor formation 528 and a portion of the washer 550 are received, the cover plate 570 being bonded to the rear ballast body part 526 by a suitable adhesive.

The mass of the foam material of the rear ballast body part 526 (which is relatively more dense than the foam material of the front compression body part 524), together with the mass of the ballast washer 550, the mass of the spacer stem 516 and the mass of the cover plate 570 provides ballast rearwardly of the frontal impact zone. The mass of the ballast is at least three times the mass of the front compression body part. The diameter D of the anchor formation is slightly greater than half of the diameter of the rear ballast body part 526.

The rear ballast body part 526 contributes to the mass of the ballast and also serves as a shock absorber between the relatively less dense front compression body part 524 and the rigid plastics cover plate 570 when the ball impacts on a bat or playing surface.

In a typical example of the streamer ball 500, the front compression body part 524 has a diameter of 45 mm and a mass of 0.7 g. The rear ballast body part 526 has a mass of 0.2 g and the ballast washer 550 has a mass of 1.5 g. Furthermore, the spacer stem 516 has a mass of 2 g and the cover plate 570 has a mass of 2.6 g. Therefore, the ballast comprising the rear ballast body part 526, the ballast washer 550, the spacer stem 516 and the cover plate 570 has a mass of 6.3 g. (The streamers 30 do not contribute to the mass of the ballast). The mass of the ballast is thus nine times the mass of the front compression body part.

Figure 7:
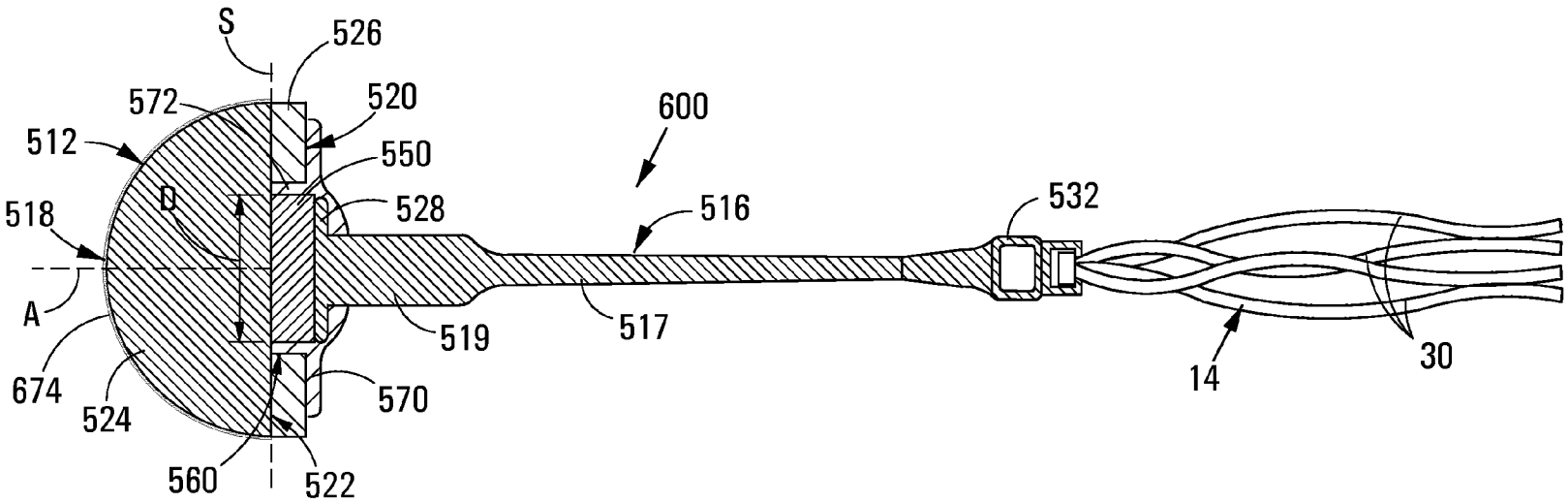
FIG. 7 shows a cross-sectional side view of a seventh embodiment of a streamer ball in accordance with the invention.

With reference to FIG. 7 of the drawings, a seventh embodiment of a streamer ball in accordance with the invention, is designated generally by the reference numeral 600. The streamer ball 600 is similar to the streamer ball 500 with the only difference being that the streamer ball 600 has a protective cover element in the form a protective skin 674 which covers the front compression body part.

Figure 8:
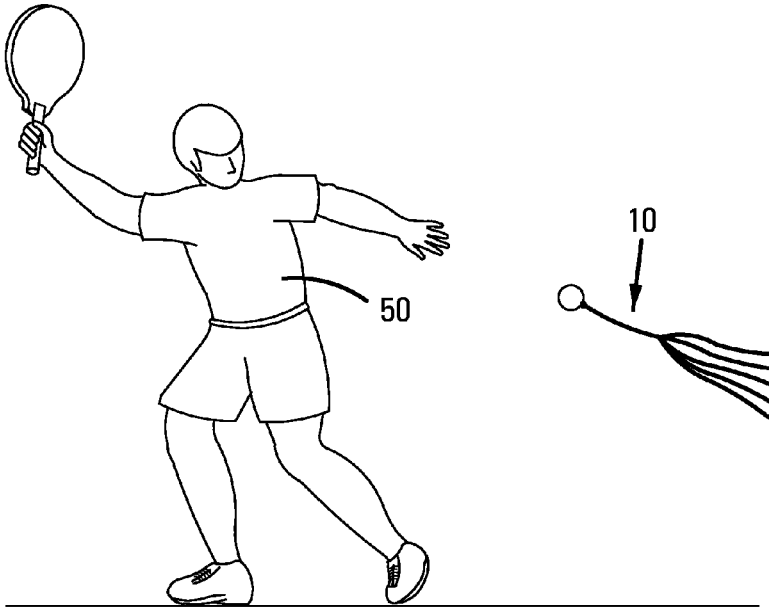
FIGS. 8 and 9 illustrate the orientation of the streamer ball as shown in FIG. 1, during play and also immediately before, during and after impact when playing a tennis-type game.

FIG. 8 illustrates a player 50 playing a tennis-type game, preparing to strike a streamer ball 10, in accordance with the invention, the streamer ball being illustrated in its typical flight configuration.

Figure 9:
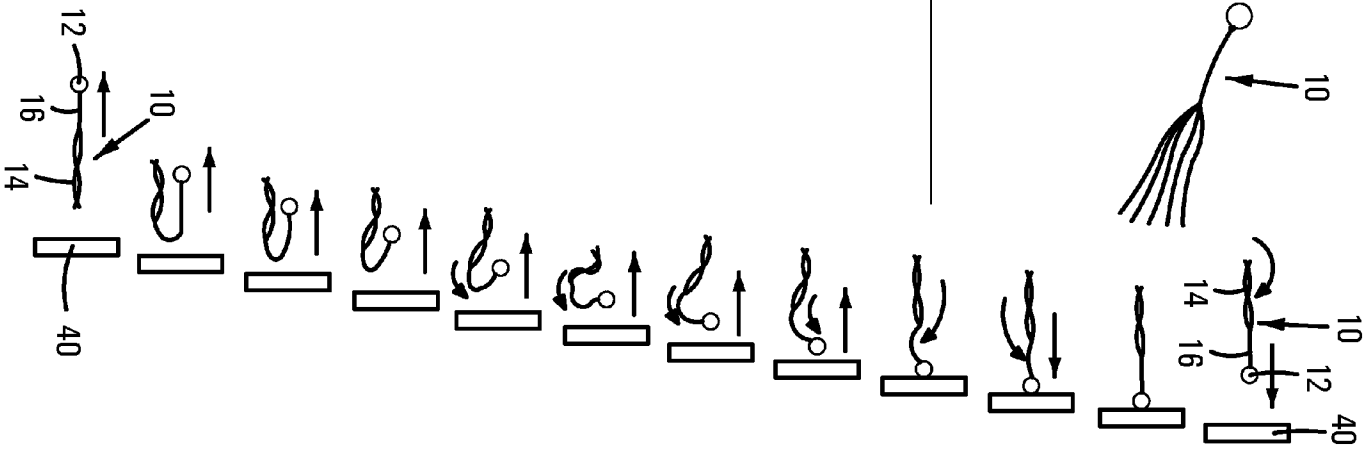

FIG. 9 particularly illustrates an approximation of a sequence of events associated with a streamer ball 10, in accordance with the invention, being struck with a bat 40.

As is clear from these illustrations, upon being struck, the impact body 12 is stopped by the bat 40, while the stem initially flexes and then causes the ball to rotate through 180°, as it initiates its flight away from the bat 40. The mass of the streamers is kept to a minimum so as to cause as little reduction to the spring of the impact body off a bat or playing surface as possible. The tail of the streamer ball generates drag rearwardly of the impact body and causes the streamer ball to follow a regular flight path. As such, the streamers reduce any tendency of the ball to spin or swerve while in flight.

Figure 10:
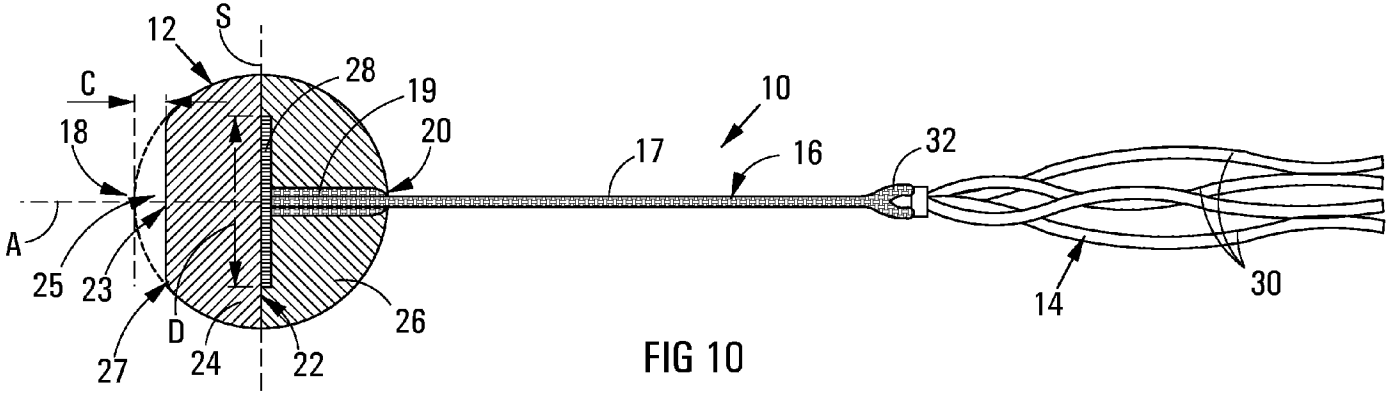
FIG. 10 shows an enlarged cross-sectional side view of the streamer ball of FIG. 1 at the moment of impact wherein the frontal impact zone is compressed by contact with a bat.
Figure 11:
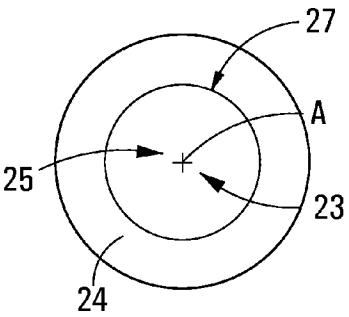
FIG. 11 shows a front view of the streamer ball of FIG. 10.
Figure 12:
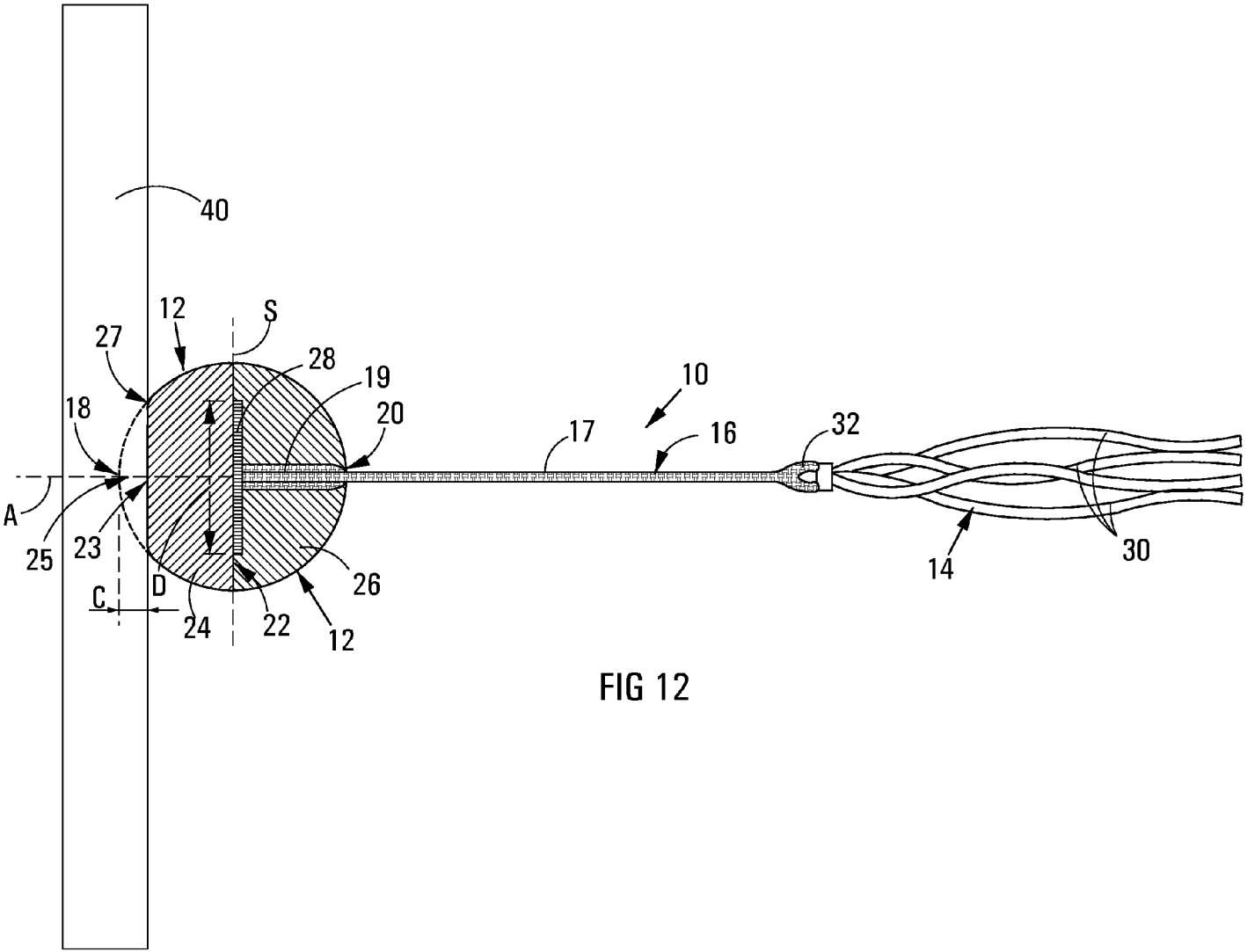
FIG. 12 shows a cross-sectional side view of the streamer ball of FIG. 10 at the moment of impact with a bat.

With reference to FIGS. 10 to 12 of the drawings, the compression of the frontal impact zone 23 of the streamer ball 10 upon impact by a bat, is illustrated. In FIGS. 10 to 12, the compression is illustrated by a flattened zone 25 of the frontal impact zone 23, the boundary edge of the flattened zone 25 being designated by the reference numeral 27. The amount of compression of the 50 mm diameter impact body in this instance is 5 mm and is designated in FIGS. 10 to 12 by the reference letter "C". In FIG. 12, the streamer ball is shown at the moment of impact with a bat 40 having an untensioned ball-striking surface, illustrating the compression of the frontal impact zone of the impact body upon impact.

In order for the streamer ball in accordance with the invention, to spring with adequate speed off a bat or rigid playing surface, the impact body must resiliently compress adequately upon impact so as to dwell sufficiently long on the ball-striking face of the bat or playing surface so as to provide for adequate transfer of kinetic energy to the impact body. This also provides a desirable solid impact feel and sound upon impact with the bat. In order to provide the impact body with the required compressibility, it is necessary to produce the frontal impact zone of the impact body of a relatively soft and low density solid foam material. As a result, this has the effect of reducing the mass of the impact body which would have a detrimental effect on the performance of the streamer ball. The use of lower density foam material in order to achieve the desired compressibility becomes a significant problem in the case of streamer balls having impact bodies having a relatively low mass of less than 30 g. Sufficient mass rearwardly of the frontal impact zone is required in order to provide for the necessary compression of the frontal impact zone upon impact with a bat having a rigid, untensioned ball-striking surface or rigid playing surface. Accordingly, in designing the streamer ball, it was necessary to provide a streamer ball having ballast which is located rearwardly of the front compression body part in order to compensate for the lack of adequate mass of the softer, less dense front compression body part. Ballast having a mass of at least three times that of the front compression body part has been found by the Applicant to provide the required compression of the frontal impact zone upon impact.

It will therefore be appreciated that the construction of the impact body of the streamer ball in accordance with the invention, provides for sufficient weight rearwardly of the frontal impact zone of the impact body in order to achieve solid contact between the ball-striking surface of a bat and to impart adequate kinetic energy to the ball upon impact, while the resilient compressibility of the frontal impact zone of the impact body acted upon by the higher mass located rearwardly of the frontal impact zone, provides the streamer ball with a relatively long dwell time upon the bat at impact. These properties of the streamer ball combine to provide the streamer ball with its beneficial performance characteristics upon impact with a rigid, untensioned bat or rigid playing surface. It will be appreciated that, when the streamer ball is used with a bat having an untensioned, rigid ball-striking surface, there is a direct relationship between the length of the dwell time and the amount of compression of the impact body. There is also a relationship between the depth of compression and the amount of energy which is stored by the ball upon impact and released immediately after full compression is achieved.

The frontal impact zone of the impact body thus has sufficient resilient compressibility to provide the impact body with the required dwell time upon the bat at impact. Furthermore, the ballast disposed rearwardly of the frontal impact zone, being at least seven times heavier than the frontal impact zone, provides the impact body with sufficient weight to transfer sufficient impact force from a location rearwardly of the frontal impact zone to the frontal impact zone part so as to provide for sufficient compression of the front compression body to achieve the abovementioned impact feel and sound. The frontal impact zone also exhibits the required resilient compressibility which in combination with the ballast, provides adequate spring off a bat or playing surface upon impact. In particular, the construction of the streamer ball in accordance with the invention, is such that the front compression body part of the impact body compresses at least 3 mm when subjected to a drop test. The Applicant has found that a compression of at least 3 mm will provide the streamer ball with the required performance characteristics described above. The impact body with the spacer stem connected thereto, is configured so as to bounce to a height of at least 50 cm and preferably at least 80 cm, when subjected to a drop test.

The combined mass of the frontal impact zone of the impact body and of the ballast rearwardly of the separation plane is between 3 g and 30 g thereby rendering the streamer ball suitably matched for use with relatively lightweight bats.

For the reasons set out above, the streamer balls 10, 100, 200, 300, 500 and 600 are specifically configured so as to have the performance characteristics deemed by the Applicant be suitable for use in bat and bouncing ball tennis-type games played with bats having rigid, untensioned ball-striking surfaces.

The invention claimed is:

1. A streamer ball for use in bat and ball tennis-type games wherein the ball is required to bounce on a playing surface and wherein the games are played with a bat having an untensioned, rigid ball-striking surface, the streamer ball comprising:

an impact body having a leading end and a trailing end and a central longitudinal axis extending between the leading and trailing ends and passing through the centre of mass of the impact body, the impact body including a generally convexly curved frontal impact zone defining the leading end, which includes a resiliently compressible impact member of a homogeneous polymeric foam material having a density of between 25 kg/m$^3$ and 70 kg/m$^3$, which is operable to resiliently compress when an impact force is applied to the frontal impact zone;

a tail comprising at least one elongate thin, flexible streamer configured to trail behind the impact body in flight; and a spacer stem comprising a resiliently flexible, elongate stem formation having two ends; an anchor formation at one end of the stem formation which is formed to provide for connection of the stem formation to the impact body; and an attachment formation at the other end of the stem formation providing for attachment of the tail to the stem formation, the spacer stem separating an attachment location of the tail from the trailing end of the impact body by at least 15 mm, the configuration of the impact body and the spacer stem attached thereto, being such that the frontal impact zone of the impact body compresses to a compression depth of between 3 mm and 10 mm when subjected to a drop test and the impact body bounces to a height of at least 50 cm when subjected to said drop test, the streamer ball including ballast comprising any components of the streamer ball which have a relatively higher density than the density of the impact member and which are disposed rearwardly of the impact member, but excluding the tail, the mass of the ballast being at least three times the mass of the impact member of the impact body, with the combined mass of the ballast and the impact member being less than 30 g, the streamer ball defining a separation plane which separates the impact member from the ballast, the separation plane extending substantially perpendicularly with respect to the longitudinal axis and intersecting the longitudinal axis at a point spaced at least 5 mm rearwardly of the leading end.

2. The streamer ball as claimed in claim 1, wherein the configuration of the impact body and the spacer stem is such that the frontal impact zone of the impact body compresses to a compression depth of 4 mm to 8 mm when subjected to said drop test.

3. The streamer ball as claimed in claim 1, wherein the combined mass of the ballast and the frontal impact zone is between 3 g and 25 g.

4. The streamer ball as claimed in claim 1, wherein the mass of the ballast is at least five times the mass of the impact member of the impact body.

5. The streamer ball as claimed in claim 1, wherein the polymeric foam material of the impact member of the impact body is of the closed cell type.

6. The streamer ball as claimed in claim 1, wherein the impact member of the impact body has a Shore Hardness of not more than 25 on the type A durameter scale.

7. The streamer ball as claimed in claim 1, wherein the impact body comprises a front compression body part which comprises said frontal impact zone and a rear ballast body part of a material which is relatively more dense than the material constituting the front compression body part thereby rendering the rear ballast body part relatively heavier than the front compression body part.

8. The streamer ball as claimed in claim 7, wherein the rear ballast body part includes a ballast insert.

9. The streamer ball as claimed in claim 8, wherein the ballast insert is configured such that it has a width dimension which is at least half of a maximum width dimension of the impact body wherein the width dimensions of the ballast insert and of the impact body are calculated along axes perpendicular to the longitudinal axis of the impact body.

10. The streamer ball as claimed in claim 7, wherein the rear ballast body part is disposed between the front compression body part of the impact body and the spacer stem and is of a resiliently compressible material so as to serve as a shock absorber for absorbing impact forces which act upon the front compression body part and which are transmitted rearwardly when the front compression body part impacts a relatively hard surface, in use.

11. The streamer ball as claimed in claim 1, which includes a cover element of a durable wear-resistant material covering the frontal impact zone of the impact body.

12. The streamer ball as claimed in claim 1, wherein the configuration of the impact body and the spacer stem is such that the impact body bounces to a height of at least 80 cm when subjected to a drop test.

13. The streamer ball as claimed in claim 1, wherein the streamer constituting the tail comprises an elongate flexible element of synthetic plastics material having a thickness of less than 0.2 mm.

14. The streamer ball as claimed in claim 13, wherein the streamer has a thickness less than 0.06 mm.

15. The streamer ball as claimed in claim 1, wherein the streamer has a length of not less than two times the length dimension of the impact body.

16. The streamer ball as claimed in claim 1, wherein the tail comprises two or more streamers.

* * * * *